US008011347B2

(12) United States Patent
Lhote et al.

(10) Patent No.: US 8,011,347 B2
(45) Date of Patent: Sep. 6, 2011

(54) APPARATUS AND METHOD FOR PRESSURE RELIEF IN AN EXHAUST BRAKE

(75) Inventors: Andre F. Lhote, Burnaby (CA); Vincent A. Meneely, Surrey (CA); Gabriel Gavril, Burnaby (CA); Tamara Spence, Abbotsford (CA); John P. Hartley, Blaine, WA (US)

(73) Assignee: Jenara Enterprises, Ltd., Surrey (CA)

( * ) Notice: Subject to any disclaimer, the term of this patent is extended or adjusted under 35 U.S.C. 154(b) by 0 days.

(21) Appl. No.: 12/848,298

(22) Filed: Aug. 2, 2010
(Under 37 CFR 1.47)

(65) Prior Publication Data

US 2010/0293932 A1 Nov. 25, 2010

Related U.S. Application Data

(63) Continuation of application No. 10/564,366, filed as application No. PCT/CA2004/002080 on Dec. 6, 2004, now Pat. No. 7,765,981.

(30) Foreign Application Priority Data

Dec. 16, 2003 (CA) ..... 2453593

(51) Int. Cl.
*F02D 9/06* (2006.01)
*F02D 9/00* (2006.01)
*F01N 1/00* (2006.01)

(52) U.S. Cl. ..... 123/323; 251/305; 188/273

(58) Field of Classification Search ..... 123/323, 123/320; 251/236, 305; 188/273; 137/630.12
See application file for complete search history.

(56) References Cited

U.S. PATENT DOCUMENTS 3,838,670 A * 10/1974 King ..... 123/323
4,205,704 A * 6/1980 Benson ..... 137/630.12
4,556,027 A * 12/1985 Harris ..... 123/323
5,113,652 A * 5/1992 Baines et al. ..... 123/323
6,305,349 B1 * 10/2001 Harris ..... 123/323
7,765,981 B2 * 8/2010 Lhote et al. ..... 123/323

* cited by examiner

*Primary Examiner* — Hieu T Vo
(74) *Attorney, Agent, or Firm* — Berenato & White, LLC

(57) ABSTRACT

An exhaust brake has a body with a passageway for exhaust gases therein. A valve member is movably located within the passageway for selective movement between an open position where the valve member opens the passageway and exhaust gases are free to move through the passageway and a closed position where the valve member blocks the passageway and the passage of exhaust gases through the passageway. The valve member has an aperture therethrough to permit a limited flow of exhaust gases through the aperture when the aperture is open. An exhaust valve actuator mechanism is coupled to the valve member for moving the valve member between the open position and the closed position. A closure member is positioned adjacent to the aperture. The closure member has an open position where the closure member is spaced apart from the valve member and permits a flow of exhaust gases through the aperture and the closure member having a closed position where the closure member contacts the valve member about the aperture and inhibits a flow of exhaust gases through the aperture, An actuator member operatively engages the closure member. There is a relief actuator mechanism, the relief actuator mechanism including an actuator member that operatively engages the closure member. The relief mechanism brings the closure member into operative engagement with the valve member with sufficient force, when the valve member is closed, to maintain the closure member in the closed position when the exhaust gases are below a predetermined pressure.

17 Claims, 8 Drawing Sheets

APPARATUS AND METHOD FOR PRESSURE RELIEF IN AN EXHAUST BRAKE

CROSS-REFERENCE TO RELATED APPLICATION AND CLAIM TO PRIORITY

This application is a continuation of application Ser. No. 10/564,366, filed Jan. 12, 2006, now U.S. Pat. No. 7,765,981 B2, issued Aug. 3, 2010, which is a national phase application of PCT No. CA04/02080, filed on Dec. 6, 2004, which claims priority to Canadian Patent No. 2,453,593, filed on Dec. 6, 2003, the disclosures of which are incorporated herein by reference and to which priority is claimed.

BACKGROUND OF THE INVENTION

This invention relates to an exhaust brake with a pressure relief device, an engine equipped with an exhaust brake and the pressure relief device, as well as to a method of preventing a buildup of excessive pressure in an exhaust brake.

Diesel engines in vehicles, particularly larger trucks, are commonly equipped with exhaust brakes for engine retarding. An exhaust brake consists of a restrictor element mounted in the exhaust system. When this restrictor closes, back pressure resists the exit of gases during the exhaust cycle and provides braking power for the vehicle.

With conventional fixed geometry exhaust brakes, the retarding power decreases sharply as engine speed decreases. This occurs because the restriction is typically optimized to generate maximum allowable back pressure at rated engine speed. The restriction is accordingly too small to be effective with the lower mass flow rates encountered at lower engine speeds.

Systems have been developed to optimize the retarding power of exhaust brakes over a range of engine speeds. One approach has been to implement pressure relief as a means to limit maximum developed exhaust pressure. Engine braking mainly occurs at lower engine speeds where exhaust pressures are lower and the pressure relief device is not active. The pressure relief device only operates when engine speeds are higher and the exhaust pressure is accordingly higher. This means that the exhaust pressure can be increased for engine braking purposes without being excessive at high engine speeds.

SUMMARY OF THE INVENTION

There is provided, according to one aspect of the invention, an exhaust brake comprising a body having a passageway for exhaust gases therein. A valve member is movably located within the passageway for selective movement between an open position, where the valve member opens the passageway and exhaust gases are free to move through the passageway, and a closed position where the valve member blocks the passageway and the passage of exhaust gases through the passageway. The valve member has an aperture therethrough to permit a limited flow of exhaust gases through the aperture when the aperture is open. An exhaust valve actuator mechanism is coupled to the valve member for moving the valve member between the open position and the closed position. A closure member is positioned adjacent to the aperture. The closure member has an open position where the closure member is spaced apart from the valve member and permits a flow of exhaust gases through the aperture. The closure member has a closed position where the closure member contacts the valve member about the aperture and prevents a flow of exhaust gases through the aperture. There is a relief actuator mechanism, the relief actuator mechanism including an actuator member which operatively engages the closure member. The relief mechanism brings the closure member into operative engagement with the valve member with sufficient force, when the valve member is closed, to maintain the closure member in the closed position when the exhaust gases are below a predetermined pressure.

According to another aspect of the invention, there is provided a method for preventing excessive pressure buildup in an exhaust brake for an internal combustion engine, said brake having a passageway for exhaust gases, a valve member movably located within the passageway for selective movement between an open position, where the valve member opens the passageway and exhaust gases are free to move through the passageway, and a closed position where the valve member blocks the passageway and inhibits the passage of exhaust gases through the passageway. The method includes providing an aperture through the valve member to permit a limited flow of exhaust gases through the aperture when the aperture is open. A closure member is positioned adjacent to the aperture so the closure member has an open position where the closure member is spaced apart from the valve member and permits a flow of exhaust gases through the aperture. The closure member has a closed position where the closure member contacts the valve member about the aperture and prevents a flow of exhaust gases through the aperture. A relief actuator mechanism is provided and includes an actuator member which operatively engages the closure member. The closure member is brought into operative engagement with the valve member with sufficient force, when the valve member is closed, to maintain the closure member in the closed position when the exhaust gases are below a predetermined pressure.

DETAILED DESCRIPTIONS OF THE PREFERRED EMBODIMENTS

Figure 1:
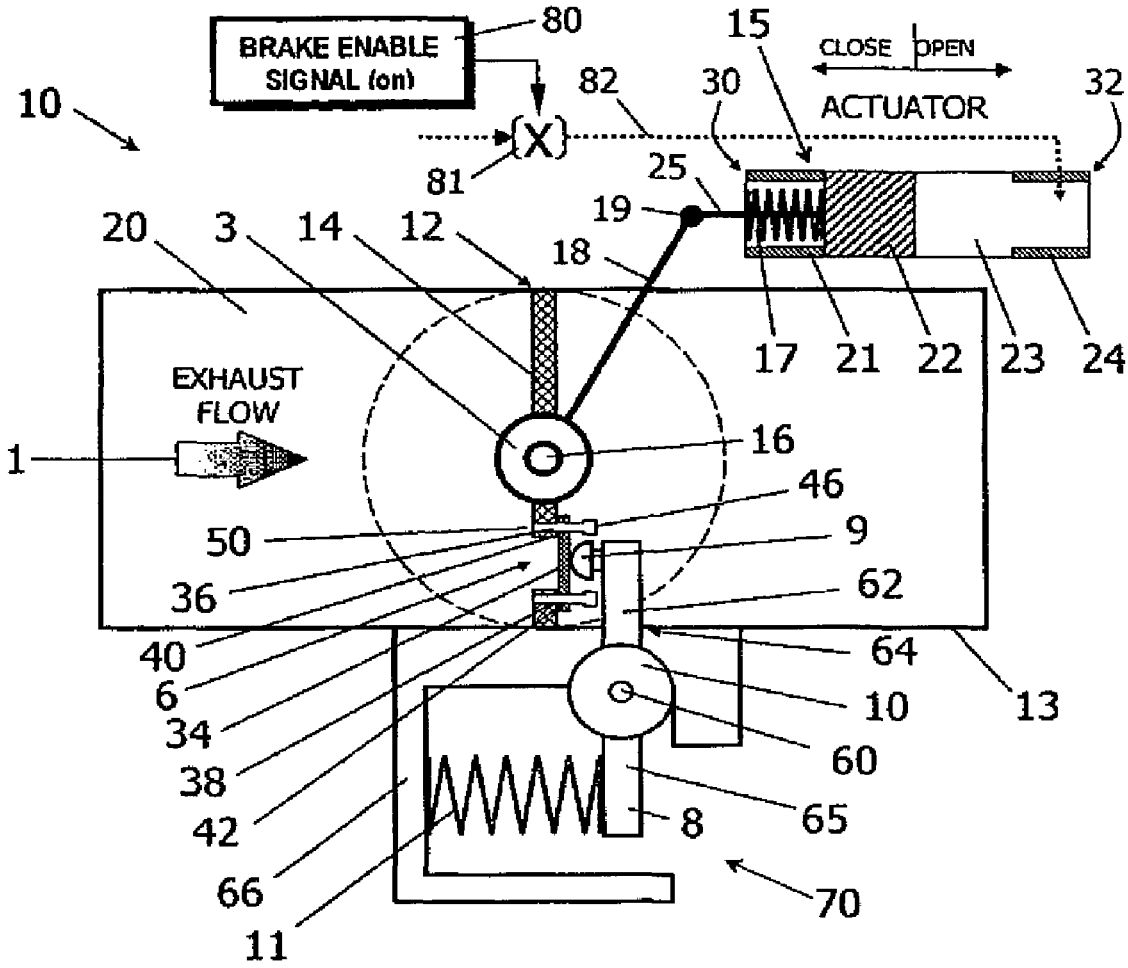
FIG. 1 is a diagrammatic, cross-sectional view of a pressure relief exhaust brake according to a first embodiment of the invention, showing the main valve member closed and the closure member closed.
Figure 2:
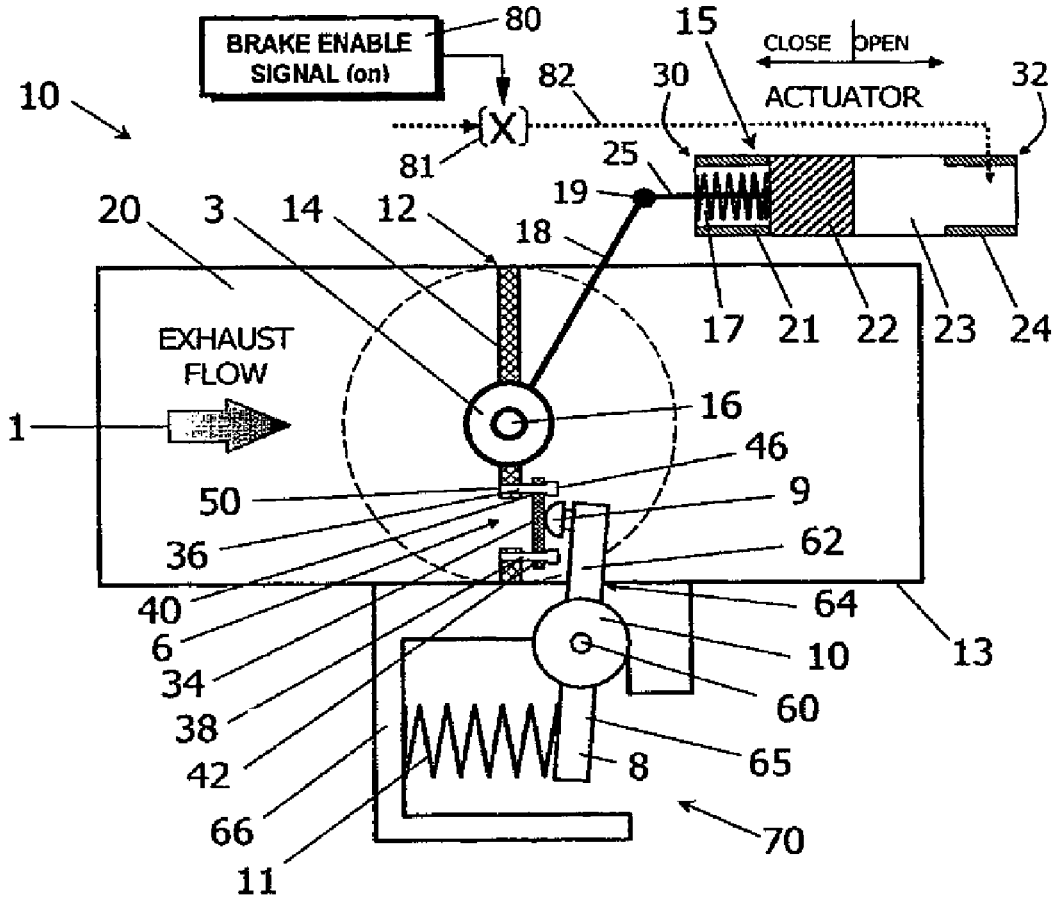
FIG. 2 is a view similar to FIG. 1, showing the main valve member closed and the closure member open.
Figure 3:
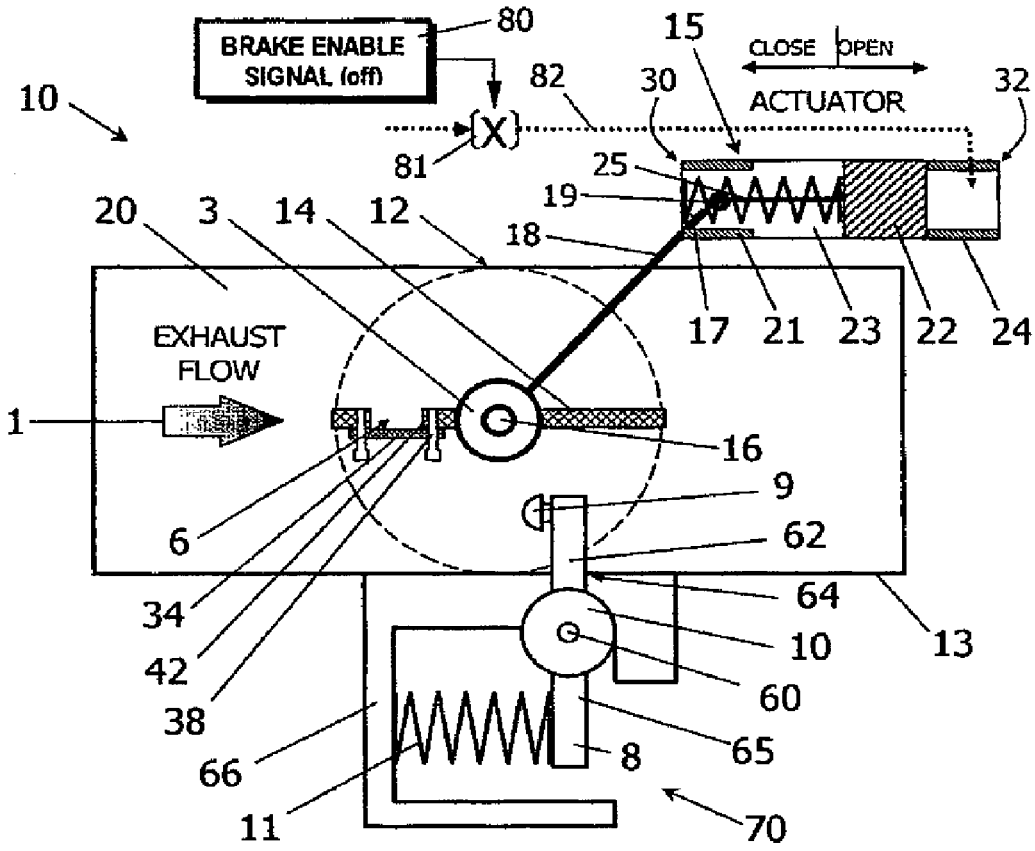
FIG. 3 is a view similar to FIG. 1, showing the main valve member open.

Referring to FIGS. 1-3, pressure relief exhaust brake 10 in this example includes a butterfly valve 12 including a valve member 14 that is rotatable about a shaft 16. Other types of valves could be used in other embodiments, such as gate valves. The valve member 14 may be replaced by other movable elements that may be placed in the engine exhaust system.

Figure 7:
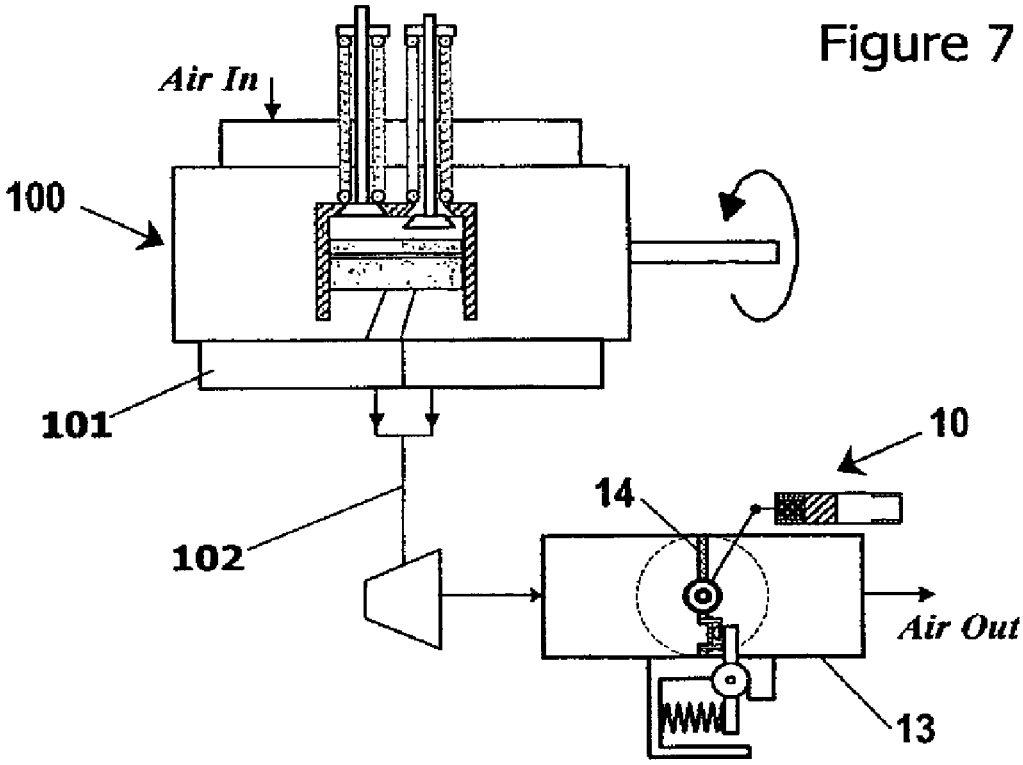
FIG. 7 is a diagrammatic view of an engine including the brake of FIG. 1.

The valve member 14 is located in body 13. FIG. 7 shows an engine 100 including an exhaust manifold 101, an exhaust conduit 102 and the exhaust brake 10. The exhaust brake is connected to the exhaust manifold by the exhaust conduit. Referring back to FIGS. 1-3, the body has a passageway 20 for exhaust gases discharged by the engine.

When completely closed, as seen in FIG. 1, the valve member in this example occupies substantially the entire area of the passageway and accordingly blocks a flow of exhaust gases from the engine. The valve member may completely stop a flow of exhaust gases through the passageway 20, apart from aperture 6 described below, or may permit a small flow of gases about the valve member when the valve member is closed.

When the valve member is open, as seen in FIG. 3, the exhaust flow is relatively unrestricted. An exhaust valve actuator mechanism 15 dictates movement of the valve member. In this embodiment mechanism 15 includes a piston 22 mounted within a cylinder 23 for reciprocation between the positions shown in FIG. 1 and FIG. 3. Movement of the piston is restricted by stops 21 and 24 at opposite ends of the cylinder. A coil spring 17, mounted between the piston and end 30 of the cylinder, biases the piston towards the opposite end 32 of the cylinder, which represents the open position of the valve member. A rod 25 is connected to the piston and extends outwardly towards end 30 of the cylinder. The rod is pivotally connected at 19 to a lever 18, which is connected to a cylindrical member 3 extending about the shaft 16. The valve member is connected to the cylindrical member so that pivoting of lever 18 by the actuator 15 opens or closes the valve member. The actuator mechanism is directed to move the valve member 14 to the open or closed position by an electronic signal from control unit 80, which operates a solenoid valve 81. When solenoid valve 81 is open, actuating fluid 82 is provided to act on piston 22 to cause the valve member 14 to close. When solenoid valve 81 is closed, actuating fluid 82 is vented and valve member 14 is allowed to open by action of spring 17.

As discussed thus far, the exhaust brake is generally conventional. However this exhaust brake departs from the conventional type in having an aperture 6 in the valve member which, when open, allows exhaust gases to flow through the valve member of the butterfly valve. There is closure member 34 sized to close the aperture 6 when pressed against the valve member as shown in FIG. 1. The closure member has a number of mounting holes. Two such holes 36 and 38 are shown in FIG. 1. A pin extends slidably through each of these holes including pins 40 and 42 shown in FIG. 1. Typically more than two such sets of pins and holes would be positioned about the closure member 34 in spaced apart relationship. Each of the pins has a head 46 as shown for pin 40. The opposite end of each pin is rigidly connected to the valve member, in this case by tight engagement with a hole 50 extending through the valve member. Thus the closure member 34 is free to move towards or away from the valve member by sliding on the pins 40 and 42.

There is a relief actuator mechanism 70 including an actuator member, in this case a lever 8, mounted for rotation about an axis 60 located exterior to the exhaust conduit. The lever has an arm 62 that extends through a slot located at 64 on the body 13. The arm 62 is fitted with a protuberance 9, which in the position of FIG. 1, is against the closure member so it seals the aperture 6. The lever 8 has an arm 65 located within a housing 66. A coil spring 11 is biased between the housing and the arm 65 so as to urge arm 62 and protuberance 9 against the closure member to seal the aperture 6.

When the valve member is closed, as seen in FIG. 2, and the pressure of exhaust gases in the conduit 20 increases, a pressure is reached whereby the force of exhaust gases on the closure member is sufficient to compress the spring 11, via arm 62 and lever 8, and causes the closure member to move away from the valve member of the butterfly valve. This allows exhaust gases to escape through the aperture 6 and accordingly limits the maximum pressure in the exhaust conduit.

When the butterfly valve is open, as seen in FIG. 3, the closure member moves away from the protuberance 9. However it may be seen that the closure member is loosely mounted since it is free to slide on the pins 40 and 42. This inhibits the closure member from adhering to the valve member of the butterfly valve in the hot temperatures encountered in the exhaust conduit.

It may be seen that the spring 11 is mounted exterior to the exhaust conduit 25 and accordingly is not subject to the high temperatures encountered in the exhaust conduit. This exterior mounting of the spring accordingly provides substantial benefits compared to arrangements where there are springs within the exhaust conduit, which may be incapable of withstanding prolonged exposure to the hot exhaust gases. Exposure to hot exhaust gases may cause loss of spring preload, which would change the pressure at which the pressure is relieved.

The outboard location of the actuator 70 provides more space for the actuator and therefore more flexibility for spring design. Also, only the relatively low-profile arm 62 and protuberance 9 extend into the exhaust gas flow when the exhaust brake is wide open, as seen in FIG. 3, thereby minimizing flow restriction.

Figure 8:
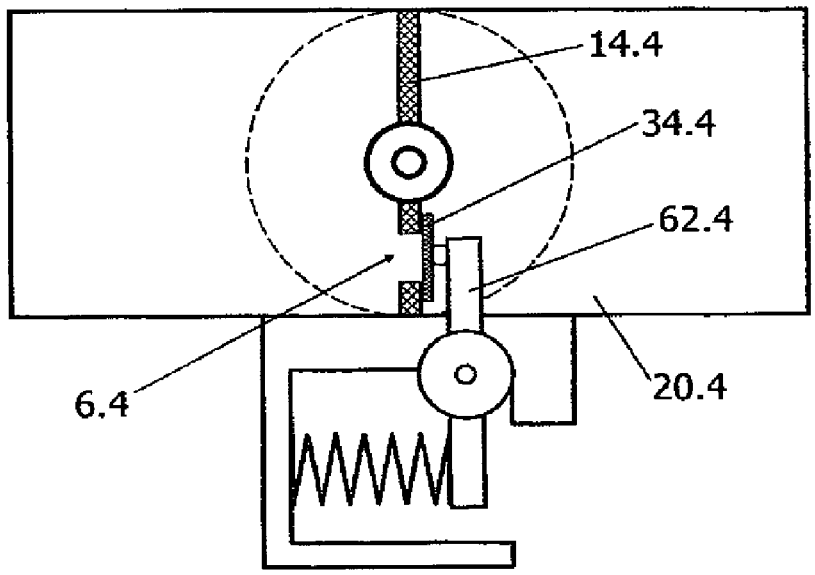
FIG. 8 is a view similar to FIG. 1, showing a fourth embodiment of the invention.

Another variation of the invention is illustrated in FIG. 8. Here like parts have like numbers as in the embodiment of FIGS. 1-3, with the additional designation "0.4". In this example, closure member 34.4 is pivotally connected to arm 62.4 and not slidably connected to valve member 14.4. Aperture 6.4 is closed by closure member 34.4 mounted directly on the arm.

Figure 4:
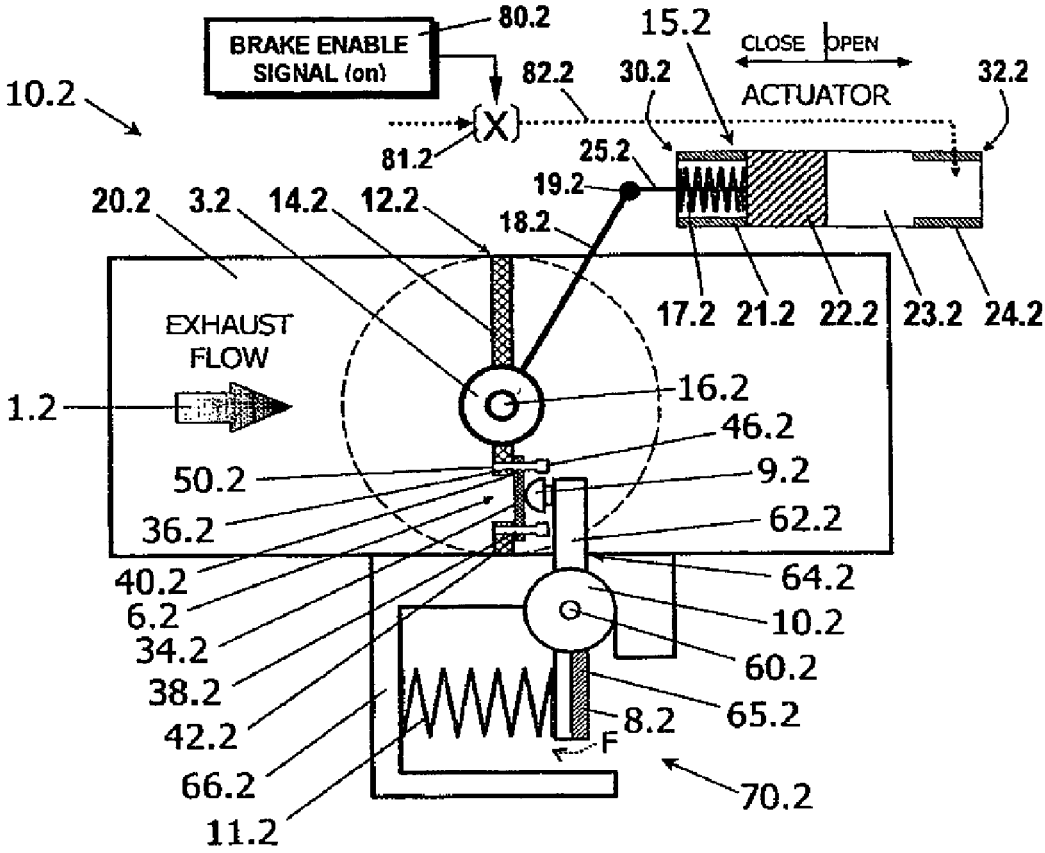
FIG. 4 is a diagrammatic, cross-sectional view of a pressure relief exhaust brake according to a second embodiment of the invention, showing the main valve member closed and the closure member closed, the relief actuator mechanism having a bi-metal construction.

Compression springs typically have the characteristic of relaxing to a reduced preload level at the elevated temperatures encountered in an internal combustion engine. With a reduced spring preload, the exhaust brake relief pressure is reduced, thereby reducing brake performance. Another embodiment of the present invention, shown in FIG. 4, resolves this issue by providing a variable actuator spring preload. Parts similar to parts of the embodiment of FIGS. 1-3 have like numbers with the addition of "0.2", Actuator lever 8.2 is of bi-metal construction, calibrated to provide a force "F" in the direction to compress spring 11.2 an additional amount as temperature increases. This additional amount of compression recovers the preload force that is lost due to spring relaxation.

The pressure relief exhaust brake can be operated to warm-up a cold engine. In a variation of the embodiments of FIGS.

1-3, there may be a smaller bleed orifice in the butterfly valve to generate the exhaust pressure for warming the engine at low engine speeds, this pressure being lower than the pressure that would open the closure member against the pressure of spring 11. This may be done by inhibiting the closure member from fully closing when acted on by the lever 8. Alternatively, a small hole may be drilled in the valve member, for example approximately 5 mm, to provide for engine warm-up. Alternatively, there may be an annular clearance between the valve member and the exhaust conduit to provide sufficient warm-up bypass mass flow.

Figure 5:
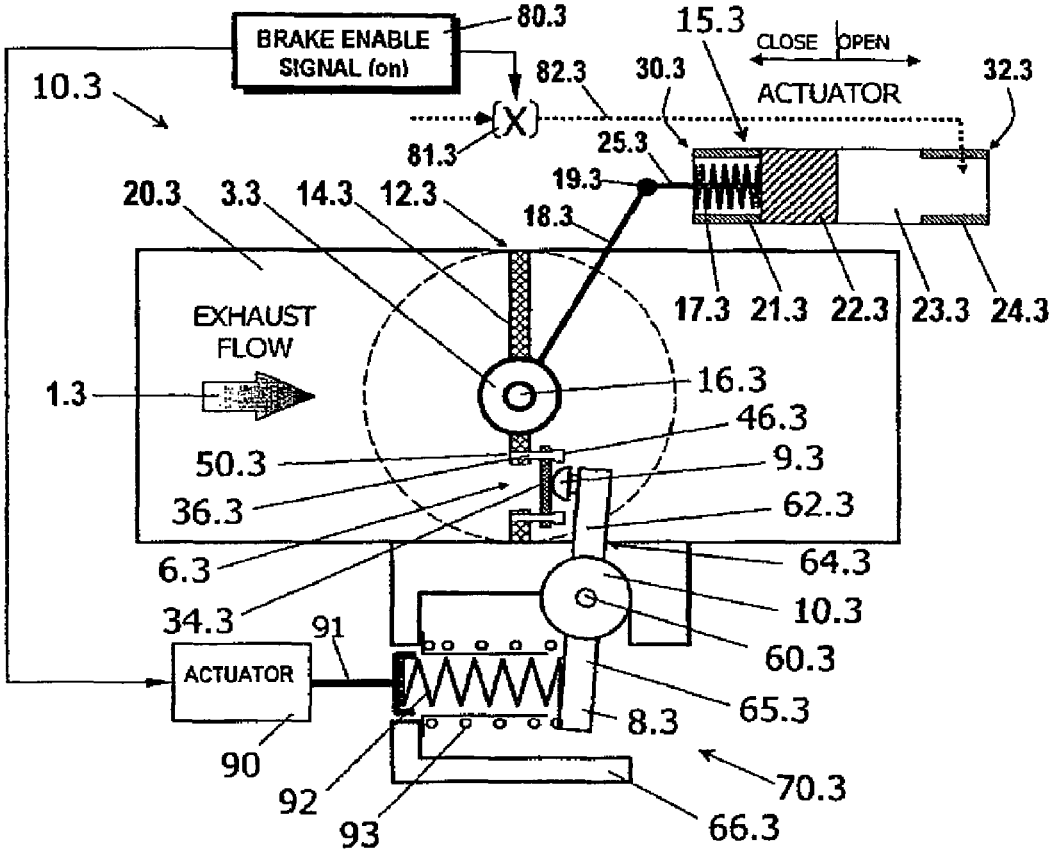
FIG. 5 is a diagrammatic, cross-sectional view of a pressure relief exhaust brake according to a third embodiment of the invention, showing the valve member closed and the closure member open, the pressure relief valve spring being acted on by a controlled actuator, the brake being shown in the engine braking mode.

Another way to provide for engine warm-up operation with the pressure relief exhaust brake is to provide a two-step opening of the closure member. This embodiment is shown in FIG. 5 where nested springs are acted on by an actuator to provide two different spring preloads and spring rates for different levels of relief pressure. In FIG. 5, actuator 90 has an armature 91. A first spring 92, with relatively high force preload, is captured between actuator armature 91 and pressure relief valve actuator lever 8.3. A second spring 93, with relatively low force preload is captured between actuator housing 66.3 and actuator lever 8.1 Spring 93 acting alone provides the force to invoke a relief pressure suitable for engine warm-up. Spring 92 and spring 93 acting together provide the force to invoke a relief pressure suitable for engine exhaust braking. In the braking mode, as shown in FIG. 5, actuator armature 91 is extended to engage spring 92 and a spring preload for engine braking is provided. In engine warm-up mode, as shown in FIG. 6, actuator armature 91 is retracted to disengage spring 92 and a spring preload for engine warm-up is provided.

In an engine operating with an activated exhaust brake, exhaust backpressure and the magnitude of subsequent exhaust valve float become greater as engine speed increases. Exhaust pressure can be raised at low engine speeds where characteristic valve float and seating velocities are low, in order to increase retarding power in this range. The exhaust pressure however must be limited at the higher engine speeds, before the limit for valve seating velocity is reached. This is accomplished with a feature for varying the relief pressure in the pressure relief exhaust brake, as illustrated in FIGS. 5 and 6. A secondary actuator 90 is employed to engage or disengage spring element 92 as required. Actuator 90 may be electromagnetic, fluid or mechanically operated and is directed by a signal from control unit 80.3. Engine operating parameters, e.g., engine speed, may be used as input to determine the characteristic of the control signal. Additional embodiments for a variable pressure relief exhaust brake are disclosed in detail below.

Figure 6:
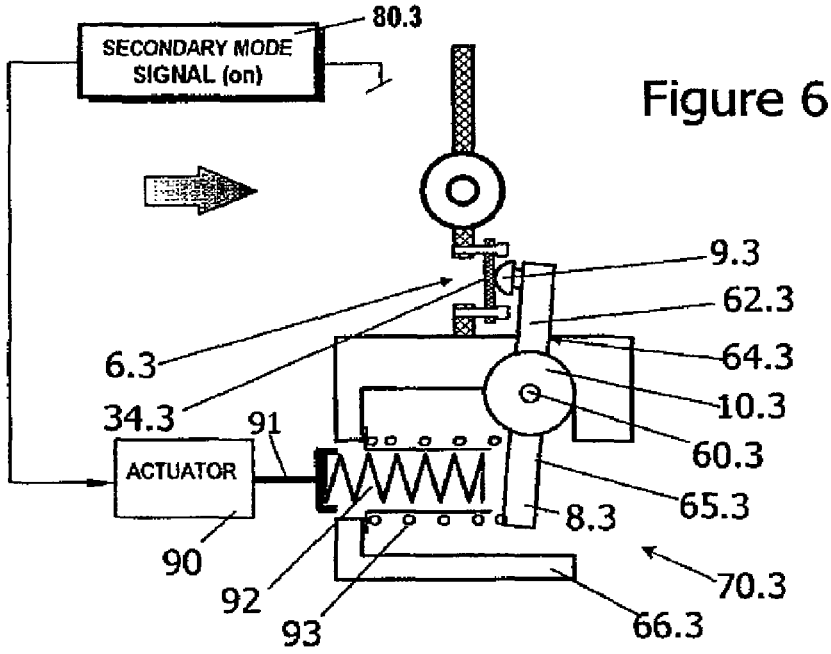
FIG. 6 is a simplified view of the embodiment in FIG. 5, showing the pressure relief valve in a secondary mode.

FIGS. 5 and 6 show the use of a spring 92, which may have a constant spring rate or a variable spring rate. The preload is variably set by the stroke of actuator armature 91. A longer stroke produces higher preload on spring 92 and raises the relief pressure. A second spring 93 may be provided for engine warm-up operation, as described previously.

Referring again to FIGS. 5 and 6, spring 92 also may be used together with spring 93 to provide a step change in relief pressure. The preload of spring 93 may provide the first preload, as shown in FIG. 6, for a first level of relief pressure. Spring 92 may be engaged, as shown in FIG. 5, to provide the higher total preload for a higher level of relief pressure.

Figure 9:
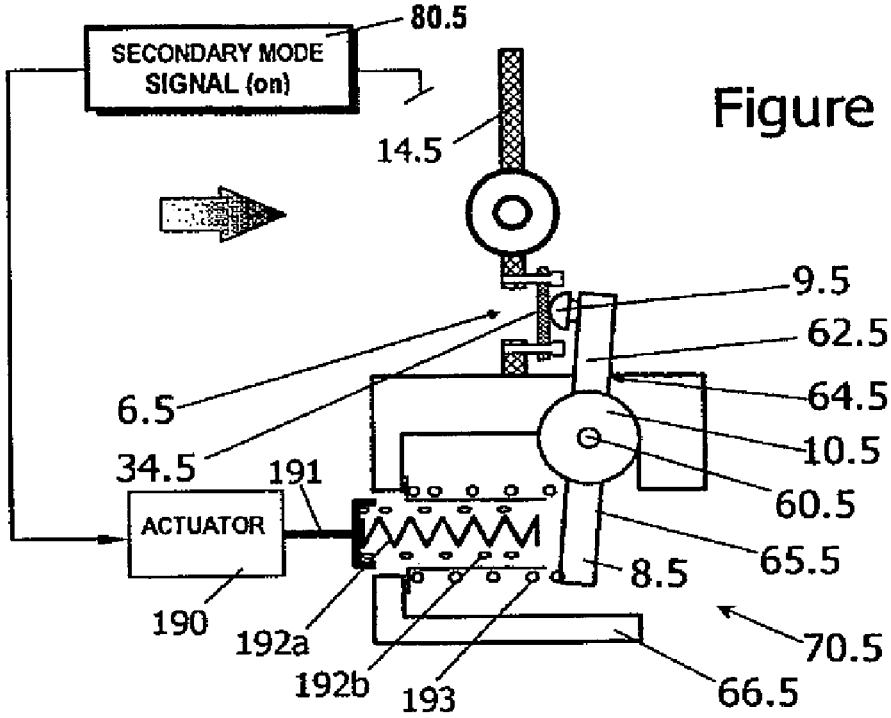
FIG. 9 is similar to FIG. 6 showing a fifth embodiment of the invention.

Referring to FIG. 9, this shows an embodiment similar to that of FIGS. 5 and 6, but using nested springs 192*a* and I 92*b*, each of which may be engaged sequentially as actuator armature 191 is extended. The engagement of each spring represents a step increase in relief pressure as the total spring preload is thereby increased. Spring 193 may be provided for engine warm-up operation, as described previously.

Figure 10:
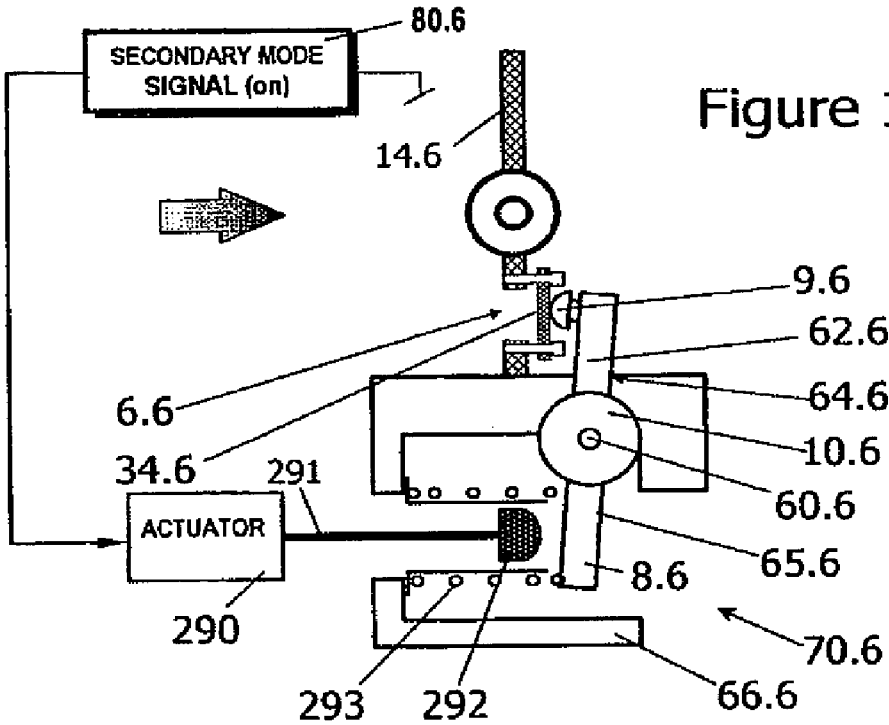
FIG. 10 is a view is similar to FIG. 9 showing a sixth embodiment of the invention.

In the variation shown in FIG. 10, a solid stop 292 is provided to disable the pressure relief actuator 70.6. When solid stop 292 engages lever 8.6, closure member 34.6 is held firmly against valve member 14.6 to prevent flow through aperture 6.6. In this mode, exhaust pressure will rise without any relief. Solid stop 292 is disengaged when pressure relief is desired, which is governed by the preload and rate of spring 293.

Figure 11:
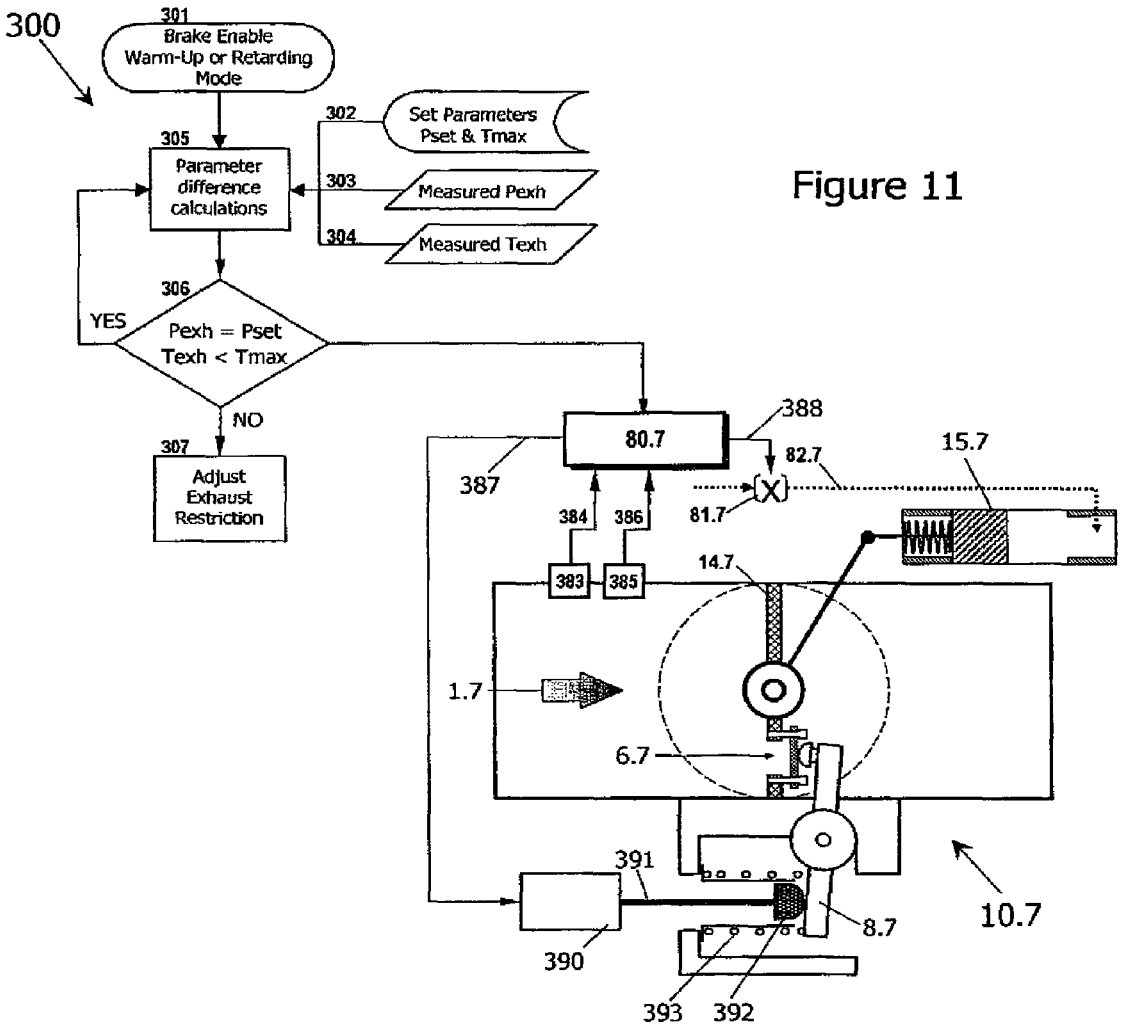
FIG. 11 is a view similar to FIG. 5 and showing a seventh embodiment of the invention.

Exhaust pressure may also be controlled electronically as in the embodiment illustrated in FIG. 11. Controller 80.7 is programmed with control algorithm 300. Pressure sensor 383 measures pressure of the exhaust gas upstream of valve member 14.7. Optionally, temperature sensor 385 may measure the temperature of the exhaust gas upstream of valve member 14.7. In response to the sensor input, control signal 388 is generated to operate actuator 15.7, which acts on valve member 14.7. Control signal 387 is generated to operate actuator 390, which acts on pressure relief actuator lever 8.7 to adjust flow of exhaust gas through aperture 6.7.

Predetermined values for the target exhaust pressure, or set pressure Pset and the maximum allowable exhaust temperature Tmax are stored in control processor 80.7 as shown at 302. Exhaust pressure signal 384 is received from pressure sensor 383 and is recorded as the measured exhaust pressure Pexh in controller 80.7 as shown at 303. Optionally, exhaust temperature signal 386 is received from temperature sensor 385 and is recorded as the measured exhaust temperature Texh in controller 80.7 as shown at 304.

Controller 80.7 compares the measured exhaust pressure to the stored value for exhaust set pressure Pset at 305. If the measured exhaust pressure does not equal Pset at 306, controller 80.7 causes actuator 390 to adjust the position of actuator lever 8.7 at 307, allowing exhaust gas to escape through aperture 6.7. Controller 80.7 receives continuous pressure signals 384 from pressure sensor 383 as shown at 303, and adjustment of actuator lever 8.7 continues until the measured exhaust pressure substantially equals Pset as shown at 306. When the measured exhaust pressure equals the predetermined exhaust pressure, the position of the actuator lever 8.7 is maintained, thereby maintaining exhaust pressure.

The temperature of exhaust flow 1.7 is important in retarding systems, particularly where both an exhaust brake and a compression release brake are used. Such a system can produce very hot exhaust temperatures, particularly at high engine speeds. Engine damage and poor retarding performance may result if exhaust temperatures exceed a maximum allowable value. With controlled exhaust brake 10.7, engine retarding performance may be optimized at temperatures below a maximum allowable temperature Tmax.

Controller 80.7 may optionally compare the measured exhaust temperature to the stored value for the maximum allowable exhaust temperature Tmax at 305. If the measured exhaust temperature is equal to or exceeds Tmax at 306, controller 80.7 causes actuator 390 to adjust the position of actuator lever 8.7 at 307, allowing exhaust gas to escape through aperture 6.7. Controller 80.7 receives continuous temperature signals 386 from temperature sensor 385 as shown at 304, and adjustment of actuator lever 8.7 continues until the measured exhaust temperature is less than Tniax at 306.

Controlled exhaust brake 10.7 may be operated in either warm-up or retarding mode. The vehicle operator selects the desired mode at 301 by use of a switch or other selection device known in the art. If the operator does not make any mode selection, the retarding mode may be designated as the default mode by controller 80.7. If warm-up mode is selected, controlled exhaust brake 10.7 is adjusted to a predetermined position by controller 80.7 50 that backpressure is provided to warm the engine after starting. The predetermined position provides a light load for warming the engine after starting. This warm-up mode continues until a predetermined parameter value is reached. This parameter may be exhaust temperature or engine coolant temperature.

The exhaust brake shown in FIGS. 1-3 also reduces loading and wear on the shaft 16 compared to a conventional exhaust brake. When the actuator 15 starts to open the butterfly valve, as it moves from the position of FIG. 1 towards the position of FIG. 3, there is a large loading on the shaft 16 due to the high pressure of exhaust gases acting against the valve member 14. In a conventional exhaust brake, this high loading causes significant friction and wear between the shaft and the bearing supporting the shaft. However, the shaft of the illustrated embodiment only encounters this high loading for a relatively small amount of movement. Once the closure member moves away from protuberance 9, the exhaust gases are free to move through the aperture 6 and thus the pressure against the valve member is significantly reduced, to decrease loading on the shaft. The other embodiments have similar advantages.

Other embodiments disclosed in the present invention have the feature to unload the exhaust pressure prior to opening the main valve member 14 at shut-off. The force requirements of the main valve actuator 15 are thereby significantly reduced. The embodiment in FIGS. 5 and 6 is provided with flow aperture 6.3 and closure member 34.3. When controller 80.3 invokes a secondary mode, as in FIG. 6, spring 92 is caused by actuator 90 to disengage from pressure relief actuator lever 8.3. Spring 93 provides only a light load for warm-up pressure and therefore allows closure member 34.3 to open easily. The high backpressure developed during exhaust braking is permitted to blow down through aperture 6.3 before actuator 15.3 is directed to open valve member 14.3. Similarly, the embodiment in FIG. 9 has a secondary mode invoked by controller 80.5, which causes springs 192*a* and 192*b* to disengage from pressure relief actuator lever 8.5. Spring 193 provides only a light load for warm-up pressure and therefore closure member 34.5 opens easily. The high backpressure developed during exhaust braking is permitted to blow down through aperture 6.5 before the main valve actuator is directed to open valve member 14.5.

The embodiment shown in FIG. 10 also provides the pressure unloading function. For this mode of operation, solid stop 292 is disengaged from lever 8.6 so that closure member 34.6 is free to move against spring 293, which is provided with a light preload so that closure member 34.6 opens easily. The high backpressure developed during exhaust braking is permitted to blow down through aperture 6.6 before the main valve actuator is directed to open valve member 14.6. The embodiment in FIG. 11 is also provided with a solid stop, 392, which acts on lever 8.7 to control movement of the closure member. Controller 80.7 specifies that solid stop 392 be fully disengaged from lever 8.7 when the exhaust brake is disabled at 301 in control algorithm 300. The closure member is therefore free to move against spring 393, which is provided with a light preload so that the closure member opens easily. The high backpressure developed during exhaust braking is permitted to blow down through aperture 6.7 before the main valve actuator 15.7 is directed to open valve member 14.7.

It will be understood by someone skilled in the art that many of the details provided above are given by way of example only and can be varied or deleted without departing from the scope of the invention as set out in the following claims.

What is claimed is:

1. An exhaust brake comprising:

a body having a passageway for exhaust gases therein;

a valve member movably located within the passageway for selective movement between an open position where the valve member opens the passageway and exhaust gases are free to move through the passageway and a closed position where the valve member blocks the passageway and the passage of exhaust gases through the passageway, the valve member having an aperture therethrough to permit a limited flow of exhaust gases through the aperture when the aperture is open;

an exhaust valve actuator mechanism coupled to the valve member for moving the valve member between the open position and the closed position;

a closure member positioned adjacent to the aperture, the closure member having an open position where the closure member is spaced apart from the valve member and permits a flow of exhaust gases through the aperture, and the closure member having a closed position where the closure member contacts the valve member about the aperture and inhibits a flow of exhaust gases through the aperture; and a relief actuator mechanism, the relief actuator mechanism including an actuator member with an arm upon which the closure member is mounted, the relief mechanism bringing the closure member into operative engagement with the valve member with sufficient force, when the valve member is closed, to maintain the closure member in the closed position when the exhaust gases are below a predetermined pressure.

2. The exhaust brake as claimed in claim 1, wherein the closure member is pivotably mounted on the arm of the actuator member.

3. The exhaust brake as claimed in claim 1, wherein the actuator member is pivotally mounted at a pivot point exterior to the passageway.

4. The exhaust brake as claimed in claim 3, wherein the actuator member includes a bimetallic element exterior to the passageway to compensate for temperature fluctuations exterior to the passageway.

5. The exhaust brake as claimed in claim 3, wherein the actuator member is biased by a biasing mechanism exterior to the passageway.

6. The exhaust brake as claimed in claim 5, wherein the biasing mechanism includes a spring.

7. The exhaust brake as claimed in claim 5, wherein the biasing mechanism includes a fluid actuator.

8. The exhaust brake as claimed in claim 5, wherein the biasing mechanism includes an electric actuator.

9. The exhaust brake as claimed in claim 5, wherein the actuator member is selectively biased by a pair of nested springs, a secondary actuator engaging one or both of said springs with the actuator member.

10. The exhaust brake as claimed in claim 5 including a secondary actuator connected the arm which holds the closure member selectively in a closed position against the pressure of exhaust gases.

11. The exhaust brake as claimed in claim 10, wherein the secondary actuator is electronically controlled.

12. The exhaust brake as claimed in claim 11, wherein the secondary actuator is electronically controlled by a controller according to pressure of exhaust gases.

13. The exhaust brake as claimed in claim 12, wherein the secondary actuator is electronically controlled by a controller according to temperature of exhaust gases.

14. The exhaust brake as claimed in claim 1, wherein the closure member is selectively biased against the valve member by a spring engaging the actuator member, a secondary actuator being engageable with the spring to selectively engage said spring with the actuator member.

15. The exhaust brake as claimed in claim 14, including a controller for disengaging said spring from the actuator member, whereby engaging or disengaging said spring provides two different levels of pressure relief.

16. The exhaust brake as claimed in claim 1, wherein said relief actuator mechanism allows the closure member to move to the open position when the exhaust gases are above the predetermined pressure.

17. The exhaust brake as claimed in claim 1, wherein the body and the valve member are components of a butterfly valve.

* * * * *